US006972078B1

(12) United States Patent
Tsou et al.

(10) Patent No.: US 6,972,078 B1
(45) Date of Patent: Dec. 6, 2005

(54) CATALYTIC POWDER AND ELECTRODE MADE THEREWITH

(75) Inventors: Yu-Min Tsou, Princeton, NJ (US); Edmond L. Manor, Brazoria, TX (US)

(73) Assignee: The Dow Chemical Company, Midland, MI (US)

( * ) Notice: Subject to any disclaimer, the term of this patent is extended or adjusted under 35 U.S.C. 154(b) by 541 days.

(21) Appl. No.: 10/089,741

(22) PCT Filed: Oct. 13, 2000

(86) PCT No.: PCT/US00/28563

§ 371 (c)(1),
(2), (4) Date: Jul. 22, 2002

(87) PCT Pub. No.: WO01/28714

PCT Pub. Date: Apr. 26, 2001

Related U.S. Application Data

(60) Provisional application No. 60/160,545, filed on Oct. 20, 1999.

(51) Int. Cl.[7] ..... C25B 11/00

(52) U.S. Cl. ..... 204/290.14; 204/290.01; 204/290.12; 204/292; 204/293; 429/40; 429/44; 502/101

(58) Field of Search ..... 204/290.01, 290.12, 204/290.14, 292, 293; 429/40, 44; 502/101

(56) References Cited

U.S. PATENT DOCUMENTS 3,486,928 A * 12/1969 Rhoda et al. ..... 427/437
5,645,930 A * 7/1997 Tsou ..... 428/328

FOREIGN PATENT DOCUMENTS

EP 0174413 * 3/1986

* cited by examiner

*Primary Examiner*—Bruce F. Bell

(57) ABSTRACT

A catalytic powder comprising a plurality of support metal particles with a porous coating (12) surrounding the metal particles (11), the porous coating comprising either an electrocatalytic metal or an electrocatalytic metal continuous phase in admixture with a particulate material (14). An electrode made with the catalytic powder and a method to make the electrode is also disclosed. The present invention is advantageous because the porous coating mixture is first applied to a powder rather than being applied directly to a metal substrate, thereby creating a large internal surface area on the electrode and accordingly, lower overpotential requirements.

20 Claims, 2 Drawing Sheets

CATALYTIC POWDER AND ELECTRODE MADE THEREWITH

The application claims the benefit of Provisional Application No. 60/160,545, filed Oct. 20, 1999.

The present invention is directed to electrocatalytic electrodes. More particularly, the present invention is directed to cathodes useful in electrolysis cells such as a chlor-alkali cell.

Chlorine and caustic soda are typically produced by electrolysis of aqueous solutions of sodium chloride, a process commonly referred to as a chlor-alkali process.

The most widely used chlor-alkali processes employ either diaphragm or membrane type cells. In a diaphragm cell, an alkali metal halide brine solution is fed into an anolyte compartment where halide ions are oxidized to produce halogen gas. Alkali metal ions migrate into a catholyte compartment through a hydraulically-permeable microporous diaphragm disposed between the anolyte compartment and the catholyte compartment. Hydrogen gas and aqueous alkali metal hydroxide solutions are produced at the cathode. Due to the hydraulically-permeable diaphragm, brine may flow into the catholyte compartment and mix with the alkali metal hydroxide solution.

A membrane cell functions similarly to a diaphragm cell, except that the diaphragm is replaced by an hydraulically-impermeable, cation-selective membrane which selectively permits passage of hydrated alkali metal ions to the catholyte compartment. A membrane cell produces aqueous alkali metal hydroxide solution essentially uncontaminated with brine.

Electrodes are usually prepared by providing an electrocatalytic coating on a conducting substrate. Useful catalytic coatings include, for example, the platinum group metals, such as ruthenium, rhodium, osmium, iridium, palladium and platinum. Useful conducting substrates include, for example, nickel, iron, and steel.

Production of chlorine gas at the anode and the concurrent production of the hydroxide ion and evolution of hydrogen gas at the cathode almost always require a cell voltage higher than the thermodynamic energy for the following reaction.

$$2\ NaCl+2H_2O \rightarrow Cl_2+H_{2+2}NaOH$$

The extra energy, that is, overvoltage, is provided to overcome among various other parameters, the electrolyte resistance and the overpotential related to the chlorine gas evolution at the anode and the overpotential related to hydrogen gas evolution and hydroxide ion formation at the cathode.

Various methods have been proposed to decrease the overpotential requirements of the electrodes by altering surface characteristics. The term "overvoltage" is used herein to refer to the excess voltage required for an electrolytic cell, while the term "overpotential" is used herein to refer to the excess voltage required for an individual electrode within the electrolytic cell.

The overpotential for an electrode is a function of its chemical characteristics and current density. Current density is defined as the current applied per unit of actual surface area on an electrode. Techniques which increase the actual surface area of an electrode, such as acid etching or sandblasting the surface of the electrode, result in a corresponding decrease of the current density for a given amount of applied current and also decrease overpotential requirements.

Efforts to reduce overpotential requirements include, for example, those described in U.S. Pat. No. 4,668,370 and U.S. Pat. No. 4,798,662, which disclose electrodes useful as cathodes in an electrolytic cell. These are prepared by coating an electrically conducting substrate such as nickel with a catalytic coating comprising one or more platinum group metals from a solution comprising a platinum group metal salt. Both of these Patents disclose electrodes designed to reduce the operating voltage of an electrolytic cell by reducing the overpotential requirements of the electrodes. In addition, U.S. Pat. No. 5,035,789, U.S. Pat. No. 5,227,030, and U.S. Pat. No. 5,066,380 disclose cathode coatings which exhibit low hydrogen overpotentials.

A desirable characteristic of a cathode coating is high porosity with large internal surface areas. Large internal surface areas result in lower effective current density and, accordingly, lower overpotentials. Another result of a porous electrode is higher resistance to impurity poisoning. Rough outer surfaces of a typical porous electrode render difficult the electrodeposition of metal ions as impurities and the large internal electroactive surface areas are not easily accessible to the impurity ions present in the electrolyte because of long Pathways for diffusion. Such characteristic is described in U.S. Pat. No. 5,645,930.

Metal plating is often used to form a reinforcement layer on the electrode. For example, U.S. Pat. No. 4,061,802 and U.S. Pat. No. 4,764,401 describe using palladium chloride to activate plastic or metal substrates prior to nickel plating by electroless deposition.

In one aspect, the present invention is a catalytic powder comprising a plurality of support metal particles comprising a transition metal or an alloy thereof, and a coating surrounding the support metal particles, the coating either comprising an electrocatalytic metal coating or comprising a coating with a metal continuous phase in admixture with a particulate material.

In a second aspect, the present invention is an electrode comprising a conductive metal substrate; and a first layer comprising a matrix with a catalytic powder dispersed therethrough, the matrix comprising a platinum group metal oxide or a mixture of a platinum group metal oxide and a valve metal oxide, the catalytic powder comprising support metal particles covered either with an electrocatalytic metal coating, or with a coating comprising an electrocatalytic metal in admixture with a particulate material.

In a third aspect, the present invention is a process for making an electrode comprising the steps of forming a catalytic powder; mixing the catalytic powder with a dispensing medium to form a mixture; applying the mixture to a conductive metal substrate to form a covered substrate; and baking the covered substrate in the presence of oxygen; and optionally reinforcing the coating adhesion and strength with an alloy coating process.

The present invention is advantageous because a porous coating mixture is first applied to a powder rather than being applied directly to a metal substrate, thereby creating a larger internal surface area relative to the prior art. Large internal surface areas result in lower effective current density and, accordingly, lower overpotentials. Therefore, because the surface area is enhanced using the present invention, the overpotential required for electrodes made according to the present invention is also reduced relative to electrodes of the prior art cited above.

Figure 1:
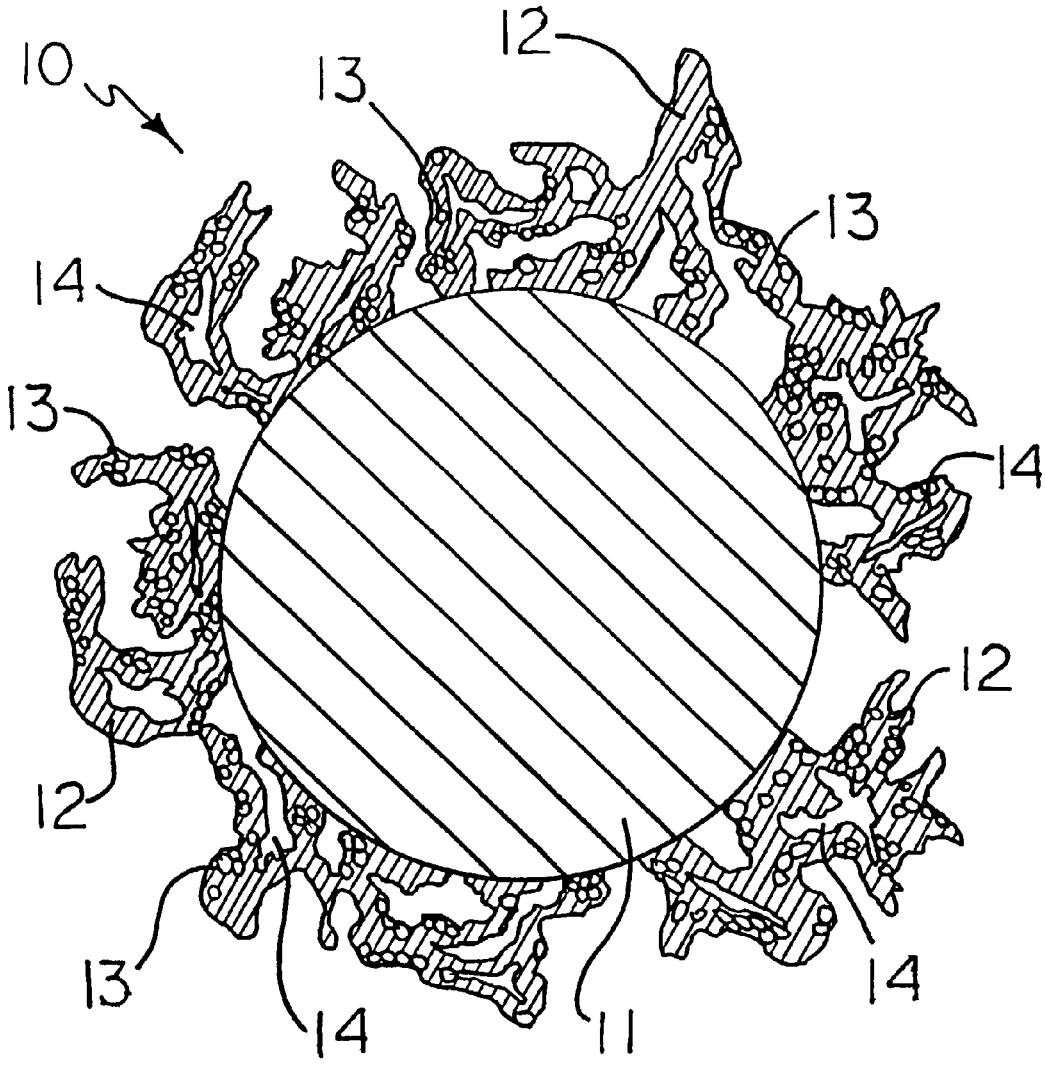
FIG. 1 is a magnified representation of a cross section of a catalytic powder particle of the present invention.

FIG. 1 illustrates a magnified view of a catalytic powder particle 10 of the present invention. As shown, the catalytic powder particle 10 comprises a support metal particle 11 surrounded by a porous coating comprising a continuous phase 12 with a particulate material 13 dispersed therethrough.

Preferably, the support metal particle 11 is a transition metal or alloy thereof. Preferred transition metals include nickel, cobalt, iron, steel, stainless steel or copper. Preferred transition metal alloys include nickel, cobalt, or copper, alloyed with phosphorous, boron or sulfur.

Preferably, the support metal particles, before the porous coating is applied thereto, have an average diameter of at least 0.2 microns, more preferably at least about 1 micron, even more preferably at least 2 microns, and yet even more preferably at least 3 microns. Preferably, the metal particles have an average diameter of up to 20.0 microns, more preferably up to 10.0 microns and even more preferably up to 6.0 microns.

The support metal particle 11 is coated with either an electrocatalytic metal or with a porous coating comprising an electrocatalytic metal continuous phase 12 in admixture with a particulate material 13. Because the coating on the support metal particle is porous and has a dendritic nature, the resulting catalytic powder particle 10 has a large internal surface area with pores 14 throughout.

Preferably, the electrocatalytic metal continuous phase 12 is ruthenium, iridium, osmium, platinum, palladium, rhodium, rhenium, or an alloy of any one or more of these.

In one embodiment, the continuous phase 12 has a particulate material 13 dispersed therethrough. Preferably, particulate material 13 comprises the metal oxides of ruthenium, iridium, osmium, platinum, palladium, rhodium, rhenium, technetium, molybdenum, chromium, niobium, tungsten, tantalum, manganese or lead, with the oxides of ruthenium, iridium osmium, platinum, palladium and rhodium being more preferred.

To make the catalytic powder, a plurality of support metal particles is covered with a porous coating comprising an electrocatalytic metal either alone or in admixture with a particulate material which comprises either or metal or metal oxide. Generally, the first step in making the catalytic powder is to prepare a deposition solution comprising at least a palladium promoter and an organic or inorganic acid.

It is known from U.S. Pat. No. 5,066,380 that the presence of palladium metal ions in the deposition solution, in addition to the metal ions of the electrocatalytic metal precursor compound, promotes deposition of the electrocatalytic metal onto the metal particles. Example of suitable palladium metal compounds are palladium halides and palladium nitrate. The concentration of the palladium metal ions in the porous coating solution should be sufficient to promote improved electrocatalyst loading on the metal particles. The palladium precursor compounds when present are, generally, included in an amount sufficient to yield a palladium metal ion concentration in the coating solution of at least 0.001 percent by weight based on the weight of the solution. The palladium metal ion concentration suitably can be 0.001 percent to 5 percent; preferably from 0.005 percent to 2 percent and, most preferably, from 0.01 percent to 0.05 percent, by weight of the coating solution. A weight percent of less than 0.001 percent is generally insufficient to promote deposition of the electrocatalytic metal. A weight percentage greater than percent 5 results in the deposition of an excessive amount of electrocatalytic metal primary phase of the coating on the substrate.

The pH of the deposition solution may be adjusted by inclusion of organic acids or inorganic acids therein. Examples of suitable inorganic acids are hydrobromic acid, hydrochloric acid, sulfuric acid, perchloric acid, and phosphoric acid. Examples of organic acids are acetic acid, oxalic acid, and formic acid. Hydrobromic acid and hydrochloric acid are preferred. The pH range for the deposition solution is, generally, 0 pH to 2.8 pH. Precipitation of hydrous platinum group metal oxide results at higher pHs. A low pH can encourage competing side reactions such as the dissolution of the substrate.

At least one electrocatalytic metal compound soluble in water or an aqueous acid is added to the deposition solution. A suitable electrocatalytic metal is, generally, one that is more noble than the metal employed for the metal particles, that is, the electrocatalytic metal precursor compound has a Gibbs free energy greater than the Gibbs free energy of the metal compound from dissolution of the metal particles, such that non-electrolytic reductive deposition occurs on the metal particles. Preferably, such electrocatalytic metal is a platinum group metal. More details non-electrolytic reductive deposition can be found in U.S. Patent 5,645,930.

The electrocatalytic metal precursor compound can be present in the deposition solution in amounts sufficient to deposit an effective amount of the metal on the metal particles. The concentration of electrocatalytic metal ions in the deposition solution, in terms of weight percent, is, generally, from 0.01 percent to 5 percent, preferably, from 0.1 percent to 3 percent and, most preferably, from 0.2 percent to 1 percent by weight of solution. An electrocatalytic metal ion concentration of greater than 5 percent is not desired, because an unnecessarily large amount of platinum group metal is used to prepare the coating solution. An electrocatalytic metal ion concentration of less than 0.01 percent is not desired, because undesirably long contact times are required.

The optional particulate material is suspended in the deposition solution at a concentration of from 0.002 to 2 percent, preferably, 0.005 to 0.5 percent, and most preferably, 0.01 to 0.2 percent.

After the deposition solution comprising the palladium promoter, the acid, and the optional particulate material is prepared, it is held at an elevated temperature and stirred at a high speed, while a powder comprising support metal particles is added thereto. After a period of time, the electrocatalytic metal precursor compound is added, and the electro-catalytic metal is formed and deposited on the support metal particles with simultaneous partial dissolution of the support metal particles.

The rate at which the electrocatalytic metal deposits to form the porous coating on the metal particles is a function of the solution temperature. The temperature, generally, ranges from 25° C. to 90° C. Low temperatures are not practical, since uneconomically long times are required to deposit an effective amount of electrocatalytic metal on the metal particles. Temperatures higher than 90° C. are operable, but generally result in an excessive amount of metal deposition and side reactions. A temperature ranging from between 40° C. to 80° C. is preferred, with 45° C. to 65° C. being most preferred.

Generally the time allowed for contact between the deposition solution and the metal particles can vary from one minute to 60 minutes. However, it should be understood that the contact time required will vary with deposition solution temperature, electrocatalytic metal concentrations, and palladium ion concentration. Contact times of from 5 minutes to 60 minutes are preferred, with from 10 minutes to 40 minutes being most preferred. Generally, it shorter contact times are desired, the method described herein may be repeated a plurality of times until an effective amount of the platinum group electrocatalytic metals deposit on the surface of the metal particles.

Figure 2:
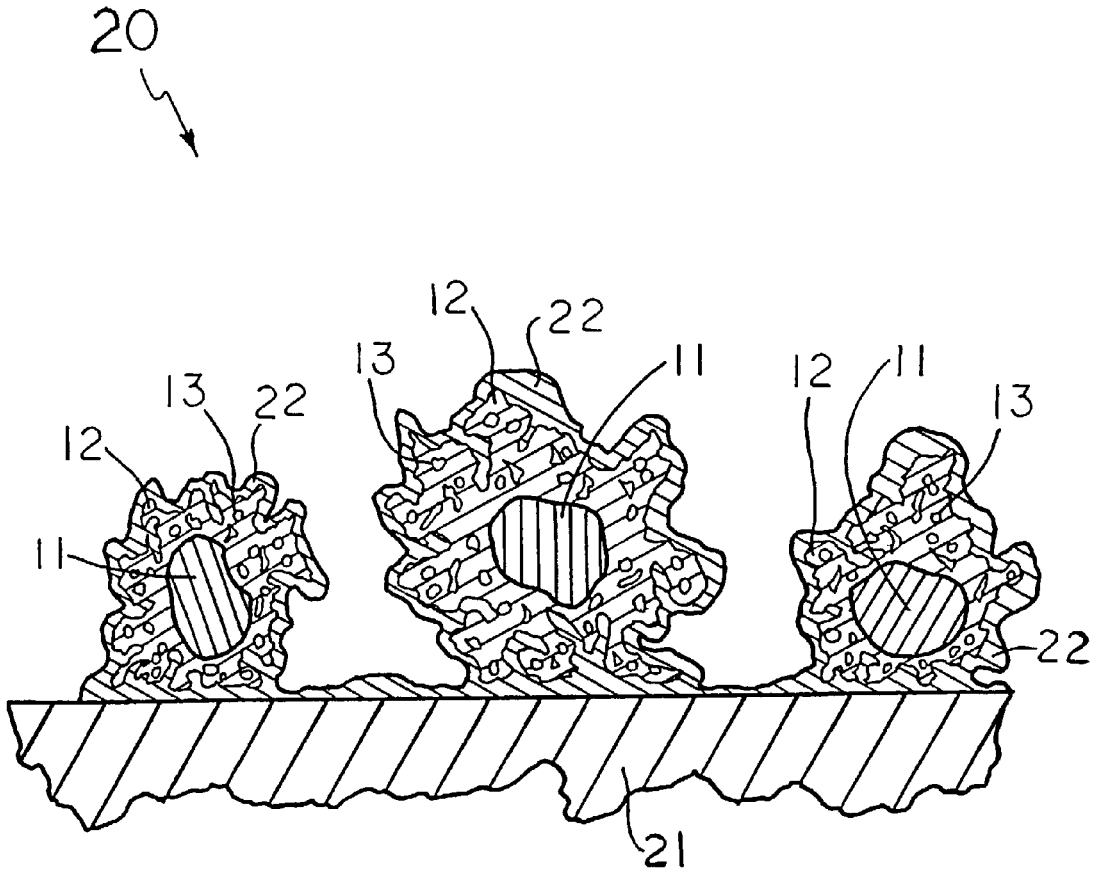
FIG. 2 is a magnified representation of a cross section of a portion of an electrode of the present invention.

The catalytic powder 10 is advantageously used to form electrodes for electrolysis cells. FIG. 2 illustrates a magnified view of a portion of an electrode 20 of the present invention. The electrode 20 comprises a conductive metal substrate 21 and a first layer, the first layer comprising a matrix 22 with the above described catalytic powder 10 dispersed therethrough. The porous dendritic nature of the catalytic powder creates a porous surface on the electrode, which in turn reduces the overpotential required for efficient operation of the electrode and electrolytic cells.

Preferably, the conductive metal substrate 21 is nickel, iron, steel, stainless steel, cobalt, copper or silver. The shape of the substrate is not critical and can be, for example, a flat sheet, a curved surface, a punched plate, a woven wire screen, or a mesh sheet.

The matrix 22 of the first layer comprises either a platinum group metal oxide or a mixture of a platinum group metal oxide and a valve metal oxide. Platinum group metal oxides include oxides of ruthenium, iridium, rhodium, osmium, platinum, palladium or a mixture of any one or more of these. Valve metal oxides include oxides of titanium, zirconium, tantalum, tungsten, niobium, bismuth, or a mixture of any one or more of these.

To make an electrode of the present invention, the above described catalytic powder is mixed with a dispensing medium to form a mixture which is applied to the conductive metal substrate to form a covered substrate. The covered substrate is then baked in the presence of oxygen.

The dispensing medium forms the matrix of the electrode and comprises either a platinum group metal oxide precursor or a mixture of a platinum group metal oxide precursor and a valve metal oxide precursor. Platinum group metal oxide precursors are those materials that form platinum group metal oxides upon baking in the presence of oxygen. Preferred platinum group metal oxide precursors include platinum group metal halides, sulfates, nitrates, nitrites, and phosphates. More preferred are platinum group metal halides, nitrates and phosphates, with platinum group metal chlorides being the most preferred. Valve metal oxide precursors are those materials that form valve metal oxides upon baking in the presence of oxygen. Preferably, the valve metal oxide precursor is titanium alkoxide, tantalum alkoxide, zirconium acetylacetonate, or niobium alkoxide.

Preferably, the dispensing medium further comprises a solvent. Suitable solvents include methanol, ethanol, 1-propanol, 2-propanol, butanol, or a mixture of any of these.

Preferably, the dispensing medium further includes a compound soluble in alkaline solutions. Examples of such soluble compounds include aluminum chloride and zinc chloride. Such alkaline soluble compounds are useful in generating pores in the coating after they are dissolved in an alkaline solution.

Any appropriate method may be used for dispersing the catalytic powder in the dispensing medium. Examples include mechanical stirring, sonicating, or combinations thereof.

The application of the catalytic powder/dispensing medium mixture can be accomplished using any suitable method. An example is spraying through a nozzle. The spraying forms a platinum group metal loading in the resulting electrode of, generally, 50 ug/cm$^2$ to 2000 ug/cm$^2$ calculated as the metal in the "atomic" form. The amount of metal in the electrode is measured by x-ray fluorescence. A preferred loading for both the elemental metal and combined oxide is from 400 ug/cm$^2$ to 1500 ug/cm$^2$ with a most preferred loading of from 500 ug/cm$^2$ to 1000 ug/cm$^2$. Loading less than 50 ug/cm$^2$ are generally insufficient to provide a satisfactory reduction of cell overvoltage. Loadings greater than 2000 ug/cm$^2$ do not significantly reduce the applied overvoltage when compared to lesser loadings within the preferred range. It should be understood that the effective amount of deposition specified above refers only to loading of the platinum group electrocatalytic metal and metal oxides in the electrode and does not include the amount of the palladium metal promoter which can be used to provide increased loading or any optional secondary electrocatalytic metal or the metal particles.

In a preferred embodiment, the substrate is protected before the mixture is applied thereto, by, for example, electroless nickel plating. Such a process is described in U.S. Pat. No. 4,061,802.

A baking step is used to convert the platinum group metal oxide precursor and valve metal oxide precursor to an oxide form. The coated substrate is baked in the presence of oxygen at a temperature of preferably at least 350° C. more preferably at least 420° C. and even more preferably at least 450° C. Preferably, the coated substrate is baked at a temperature of not more than 550° C. more preferably not more than 500° C. even more preferably not more than 480° C. Preferably the baking step occurs for anywhere from 30 to 90 minutes. It is important that the coated substrate be baked in the presence of oxygen, be it air or some other oxygen-containing substance, so that the platinum group metal oxide precursor and the valve metal oxide precursor convert to platinum group metal oxide and valve metal oxide. The result is a two-phase first layer of the electrode, one phase being the matrix, and the second phase being the catalytic powder particles dispersed through the matrix.

In a preferred embodiment, the electrode of the present invention further comprises a reinforcement layer 23. Such a reinforcement layer 23 preferably comprises a transition metal or alloy thereof. More preferably, the reinforcement layer is nickel, cobalt, copper, or alloys thereof with boron, phosphorous or sulfur.

To make the optional reinforcement layer, a second electroless plating step, which consists of plating the coated substrate with a transition metal or a transition metal alloy. Such a reinforcement layer helps hold the catalyst powder and matrix together and also helps ensure that the first layer adheres to the substrate. More details forming the reinforcement layer can be found in U.S. Pat. No. 5,645,930.

Unless otherwise specified, all parts and percentages are by weight. The following examples are not meant to be limiting.

EXAMPLES 1–3

Preparation of Catalytic Powder With Metal Particulate Material

A porous coating solution was prepared, with $PdCl_2$ as palladium promoter and 0.5 N HCl as acid. The solution was heated to a reaction temperature and continuously stirred. $RuCl_3 \times H_2O$ was added as the electrocatalytic platinum group metal compound. The resulting solution was held at the reaction temperature and stirred using a COWLES high-speed disperser, while 3-micron nickel powder (Aldrich) was added. After stirring the mixture at the elevated temperature for a desired contact time, the resulting Ru-coated nickel powder was collected on a filter paper, dried for several hours at 90° C. and weighed. The amount of Ru in the powder was determined using X-ray fluorescence. Table I lists the variables and the results.

TABLE I

| Example | 1 | 2 | 3 |
|---|---|---|---|
| 0.5N HCl solution (grams) | 500 | 1420 | 1577 |
| $PdCl_2$ (milligrams) | 20.9 | 59.3 | 6.32 |
| Reaction temp. (° C.) | 64 | 61 | 61.7 |
| $RuCl_3$ added (grams) | 2.095 | 5.95 | 2.681 |
| Nickel powder (grams) | 35.2 | 100 | 100.4 |
| Reaction time (minutes) | 15 | 5 | 5 |
| Total weight after drying (grams) | 28.13 | 83.7 | 85.22 |
| Percent Ru in powder | 3.1 | 3.0 | 3.14 |

EXAMPLES 4–6

Preparation of Catalytic Powder With Metal/Metal Oxide Agglomerates As Particulate Material A porous coating solution was prepared, with $PdCl_2$ as palladium promoter and 0.5 N HCl as acid. The solution was heated to a reaction temperature and continuously stirred. $RuO_2$ was added as the platinum group metal oxide. The resulting solution was held at the reaction temperature and stirred using a COWLES high-speed disperser operated at 3000 rpm, while 3-micron nickel powder (Aldrich) was added. $RuCl_3 \times H_2O$ was then added as the electrocatalytic platinum group metal compound. After stirring the mixture at the elevated temperature for a desired contact time, the resulting Ru-coated nickel powder was dried and weighed. The amount of Ru in the powder was determined using X-ray fluorescence. Table II lists the variables and the results.

TABLE II

| Example | 4 | 5 | 6 |
|---|---|---|---|
| 0.5N HCl solution (grams) | 1405 | 1402 | 1413 |
| $PdCl_2$ (milligrams) | 60 | 60 | 60 |
| Reaction temp. (° C.) | 51 | 52.8 | 50.6 |
| $RuO_2$ (grams) | 0.714 | 0.720 | 0.714 |
| Nickel powder (grams) | 38.84 | 38.63 | 38.14 |
| $RuCl_3$ (grams) | 8.74 | 8.75 | 8.57 |
| Reaction time (minutes) | 50 | 50 | 110 |
| Total weight after drying (grams) | 16.57 | 16.70 | 15.98 |
| Percent Ru in powder | 26.0 | 25.86 | 26.5 |

EXAMPLES 7–9

Preparation of Cathode With a Metal Particulate Material

A 5 inch by 6 inch plate was electroless nickel-plated according to procedures described in U.S. Pat. No. 4,061, 802. The plate was then sprayed with a mixture of a dispensing medium and a Ru-coated nickel powder (Ru=3.1 percent) dispersed therethrough. The powder weight percent in the spraying mixture was around 10 percent. The platinum group metal oxide precursor in the dispensing medium was $RuCl_3$, the valve metal oxide precursor compound in the dispensing medium was titanium isopropoxide. The solvent in the dispensing medium was a combination of methanol and 2-propanol, the compound soluble in alkaline solutions was aluminum chloride or zinc chloride, and the acid used to adjust pH, when used, was HCl gas.

The sprayed sample was allowed to dry at 90° C. for 20 minutes and baked at 490° C. for 60 min. X-ray fluorescence of the sample was used to determine loading of the metal on the substrate. Table III lists the parameters and results.

TABLE III

| Example | 7 | 8 | 9 |
|---|---|---|---|
| $RuCl_3 \times H_2O$ (wt. percent) | 2.37 | 2.37 | 2.37 |
| Ti(isopropoxide) (wt. percent) | 6.69 | 6.69 | 6.69 |
| Methanol (wt. percent) | 76.5 | 76.5 | 5.00 |
| 2-propanol (wt. percent) | 9.73 | 9.73 | 81.07 |
| Compound soluble in alkaline solution (wt. percent) | 3.43 ($AlCl_3 \times 6H_2O$) | 3.43 ($AlCl_3 \times 6H_2O$) | 3.62 ($Zn(NO_3)2 \times 6H_2O$) |
| HCl gas (wt. percent) | 1.28 | 1.28 | 1.25 |
| Metal loading ($\mu g/cm^2$) | 151 | 133 | 169 |

EXAMPLES 10–13

Preparation of Cathode with a Metal/Metal Oxide Agglomerate Particulate Material A 5 inch by 6 inch plate was electroless nickel-plated according to procedures described in U.S. Pat. No. 4,061, 802. The plate was then sprayed with a mixture of a dispensing medium and a $Ru/RuO_2$-coated nickel powder (Ru=25.86 percent) dispersed therethrough. The powder weight percent in the spraying mixture is around 10 percent. The dispensing medium comprises 2.37 weight percent $RuCl_3 \times H_2O$ as the platinum group metal oxide precursor, 2.87 weight percent titanium isopropoxide as the valve metal oxide precursor, 8.86 weight percent methanol and 83.80 weight percent 2-propanol as the solvent, and 2.10 weight percent $AlCl_3 \times 6H_2O$ as the compound soluble in an alkaline solution.

The sprayed sample was allowed to dry at 90° C. for 20 minutes and baked at 490° C. for 60 min. X-ray fluorescence of the sample was used to determine loading of the metal on the substrate. Table IV lists the parameters and results.

TABLE IV

| Example | 10 | 11 | 12 | 13 |
|---|---|---|---|---|
| Percent Ru in catalytic powder | 25.86 | 25.86 | 25.86 | 26.0 |
| Metal loading ($\mu g/cm^2$) | 521 | 555 | 766 | 428 |

EXAMPLES 14–16

Preparation of Electrodes Having a Second Reinforcement Layer

The samples from Examples 7–9 above are coated with the second reinforcement layer of Ni—P by the following steps:

The plates were dipped in the following mixture of solutions for a period of five minutes at ambient temperature: 25 cc 0.01 M $(NH_4)2PdCl_4$ in methanol, 50 cc 0.1 M poly(4-vinylpyridine) in methanol, and 425 cc methanol. The coated plates were then dried in a horizontal position at 90° C. The dipping and drying steps were repeated.

Thereafter, the coated plates were placed in a plastic horizontal container with the thread of the plate fitted in a fitting in the bottom of the container. The container was first filled with an aqueous solution containing 36 g/l of $NaH_2PO2 \times H_2O$ at pH=2.95 for 5–10 minutes to reduce Pd(II) to Pd°. The solution was then poured out and 500 ml of an electroless nickel-plating solution was then added to the container and electroless plating was conducted for 20 min. The composition of the electroless plating solution is:

$NiCl_2 \times 6H2O$ 17.4 g/l

Sodium Citrate 30.24 g/l

NaH2PO2×H2O 25.2 g/l

NH4Cl 21.26 g/l

NH40H add to get pH=8.8

Weight gains for Example 4 (Example 7), Example 5 (Example 8) and Example 6 (Example 9) were 2.63 mg/cm$^2$, 3.26 mg/cm$^2$, and 2.69 mg/cm$^2$, respectively.

To measure the hydrogen potential, the plates were connected to a nickel rod and placed in a caustic bath at an elevated temperature. A platinum plate welded to a nickel rod was used as the anode. Current densities of 0.46 amps per square inch (ASI), 1.0 ASI, and/or 1.09 ASI were applied to the cathode sample and the anode from a rectifier. The potential of the cathode was measured with the aid of a LUGGIN probe with a Hg/HgO reference electrode. The parameters and results were listed in Table V.

TABLE V

| Example | 14 | 15 | 16 |
|---|---|---|---|
| Percent caustic in bath | 11.75 | 11.75 | 32 |
| Temperature of caustic bath (° C.) | 70 | 70 | 90 |
| Voltage at 0.46 ASI | −0.960 | −0.962 | −1.007 |
| Voltage at 1.0 ASI | — | −0.979 | — |
| Voltage at 1.09 ASI | — | — | −1.025 |

EXAMPLES 17–20

Preparation of Electrodes Having a Second Reinforcement Layer

The samples from Examples 10–13 above were coated with the second reinforcement layer of Ni—P by the following steps:

Initiation was conducted at 0.8–0.9 amperes at ambient temperature for 2–3 minutes. The plate was then placed in an electroless plating solution for 20–30 minutes. The composition of the electroless plating solution is:

NiCl2×6H2O 17.4 g/l

Sodium Citrate 30.24 g/l

NaH2PO2×H2O 25.2 g/l

NH4Cl 21.26 g/l

NH4OH add to get pH=8.8

Weight gains for Example 10 (Example 17), Example 11 (Example 18), Example 12 (Example 19) and Example 13 (Example 20) are 0.550 g, 0.578 g., 0.683 g, and 0.489 g, respectively.

EXAMPLES 20–23

Hydrogen Potential Measurements

To measure the hydrogen potential for the plates prepared in Examples 17–20, the plates were connected to a nickel rod and placed in an 11.75 percent caustic bath at 70° C. A platinum plate welded to a nickel rod was used as the anode. A current density of 0.46 ASI was applied to the cathode plate and the anode from a rectifier. The potential of the cathode was measured with the aid of a LUGGIN probe versus a Hg/HgO reference electrode. The hydrogen potential measurements for Example 17 (Example 20). Example 18 (Example 21), Example 19 (Example 22), and Example 20 (Example 23) are −0.956 volts, −0.960 volts, −0.949 volts and −0.956 volts, respectively.

What is claimed is:

1. An electrode comprising:

a conductive metal substrate; and a first layer comprising a matrix with a catalytic powder dispersed therethrough, the matrix comprising a platinum group metal oxide or a mixture of a platinum group metal oxide and a valve metal oxide, the catalytic powder comprising support metal particles covered with a porous coating, the porous coating comprising an electrocatalytic metal.

2. The electrode of claim 1 wherein the porous coating further comprises a particulate material in admixture with the electrocatalytic metal.

3. The electrode of claim 2 wherein the particulate material in the porous coating of the first layer is a metal oxide particulate material selected from the group consisting of a platinum group metal oxide, rhenium oxide, technetium oxide, molybdenum oxide, chromium oxide, niobium oxide, tungsten oxide, tantalum oxide, manganese oxide and lead oxide.

4. The electrode of claim 1 wherein the conductive metal substrate is nickel, iron, steel, stainless steel, cobalt, copper, or silver.

5. The electrode of claim 1 wherein the support metal particles in the catalytic powder are nickel, cobalt, iron, steel, stainless steel, or copper.

6. The electrode of claim 1 wherein the electrocatalytic metal in the porous coating of the first layer is ruthenium, iridium, rhodium, osmium, platinum, palladium, rhenium, or a mixture thereof.

7. The electrode of claim 1 wherein the platinum group metal oxide in the matrix is ruthenium oxide, iridium oxide, osmium oxide, platinum oxide, palladium oxide or a mixture thereof; and the valve metal oxide in the matrix is titanium oxide, zirconium oxide, tantalum oxide, tungsten oxide, niobium oxide, bismuth oxide, or a mixture thereof.

8. The electrode of claim 1 further comprising a second reinforcement layer consisting essentially of a transition metal or alloy thereof.

9. The electrode of claim 8 wherein the transition metal or alloy thereof is nickel, cobalt, copper, or alloys thereof with phosphorous, boron or sulfur.

10. A process for making an electrode comprising the steps of:

forming a catalytic powder by covering a plurality of support metal particles with a porous coating comprising an electrocatalytic metal in admixture with a particulate material;

mixing the catalytic powder with a dispensing medium to form a mixture;

applying the mixture to a conductive metal substrate to form a covered substrate; and baking the covered substrate in the presence of oxygen.

11. The process of claim 10 wherein the porous coating is formed by a nonelectrolytic reductive deposition method, an electrodeposition method or a sintering method.

12. The process of claim 10 wherein the electrocatalytic metal in the porous coating is ruthenium, iridium, rhodium, osmium, platinum, palladium, or a mixture thereof.

13. The process of claim 10 wherein the particulate material in the porous coating is a metal oxide particulate material selected from the group consisting of a platinum group metal oxide, rhenium oxide, technetium oxide, molybdenum oxide, chromium oxide, niobium oxide, tungsten oxide, tantalum oxide, manganese oxide, lead oxide and a mixture thereof.

14. The process of claim 10 wherein the applying step is performed using solvent spraying, electrostatic spraying, plasma spraying, or melt spraying.

15. The process of claim 10 wherein the dispensing medium comprises a mixture of a platinum group metal oxide precursor and a valve metal oxide precursor.

16. The process of claim 15 wherein the platinum group metal oxide precursor is ruthenium chloride; and the valve metal oxide precursor is titanium alkoxide, tantalum alkoxide, zirconium acetylacetonate, or niobium alkoxide.

17. The process of claim 15 wherein the dispensing medium further comprises aluminum chloride or zinc chloride.

18. The process of claim 17 wherein the dispensing medium further comprises a solvent selected from the group consisting of methanol, ethanol, 1-propanol, 2-propanol, butanol and a mixture thereof.

19. The process of claim 10 further comprising the step of plating the coated substrate with a transition metal or a transition metal alloy to form a reinforcement layer.

20. The process of claim 19 wherein the transition metal is nickel, cobalt, copper or an alloy thereof with phosphorous, boron or sulfur.

* * * * *